US010989393B2

(12) United States Patent
Cox

(10) Patent No.: US 10,989,393 B2
(45) Date of Patent: Apr. 27, 2021

(54) UNIVERSAL SHADE SYSTEM FOR JAR-STYLE LIGHTING FIXTURE

(71) Applicant: Connie Lea Cox, New Smyrna Beach, FL (US)

(72) Inventor: Connie Lea Cox, New Smyrna Beach, FL (US)

( * ) Notice: Subject to any disclaimer, the term of this patent is extended or adjusted under 35 U.S.C. 154(b) by 0 days.

(21) Appl. No.: 16/721,825

(22) Filed: Dec. 19, 2019

(65) Prior Publication Data

US 2020/0124254 A1 Apr. 23, 2020

Related U.S. Application Data

(63) Continuation of application No. 16/442,486, filed on Jun. 15, 2019, now abandoned.

(60) Provisional application No. 62/689,770, filed on Jun. 25, 2018.

(51) Int. Cl.
*F21V 17/12* (2006.01)
*F21V 1/00* (2006.01)

(52) U.S. Cl.
CPC ..... *F21V 17/12* (2013.01); *F21V 1/00* (2013.01)

(58) Field of Classification Search
CPC ..... F21V 17/12; F21V 1/00
See application file for complete search history.

(56) References Cited

U.S. PATENT DOCUMENTS 191,888 A * 6/1877 Schaeffer et al. ..... F21V 17/02 362/322
1,035,624 A * 8/1912 McGhee ..... F21V 17/02 362/322

* cited by examiner

*Primary Examiner* — Joseph L Williams
(74) *Attorney, Agent, or Firm* — Jason T. Daniel, Esq.; Daniel Law Offices, P.A.

(57) ABSTRACT

A shade system for a jar-style lighting fixture includes a circular shaped resilient adaptor having a first end and a second end that are secured by a fastener. An elongated curved cover is removably secured onto the adaptor via a connector and a complementary connector, and surrounds the lighting fixture horizontally along a 180-degree axis. The adaptor includes a shape and size that is complementary to the shape and size of the jar of a jar-style lighting fixture, and a rubber gasket is provided along the inside surface of the adaptor to provide grip and cushioning against the glass jar.

8 Claims, 5 Drawing Sheets

UNIVERSAL SHADE SYSTEM FOR JAR-STYLE LIGHTING FIXTURE

CROSS-REFERENCE TO RELATED APPLICATIONS

This application claims the benefit of U.S. Application Ser. No. 62/689,770 filed on Jun. 25, 2018, and U.S. application Ser. No. 16/442,486 filed on Jun. 15, 2019, the contents of each of which are incorporated herein by reference.

TECHNICAL FIELD

The present invention relates generally to improvements in lighting fixtures, and more particularly to a universal shade for a jar-style lighting sconce.

BACKGROUND

The statements in this section merely provide background information related to the present disclosure and may not constitute prior art.

Many homes, apartments and condominiums that have been built over the past 75 years have one or more lighting fixtures adjacent to an entry door. In many of these buildings that were constructed between 1950 and 1999, the preferred lighting fixture was a jar-type sconce. As is known to those of skill in the art, jar-style light sconces typically include a wall mounting bracket having a distal end for supporting a light bulb and a plain or decorative jar that surrounds the bulb.

Although such fixtures were once extremely popular due to their reliability and low cost, they have fallen out of favor with modern homeowners. Unfortunately, there has not previously existed a convenient way to modernize these fixtures, so many homeowners have been forced to physically remove the entire device and replace it with a different one. Moreover, because these fixtures are directly wired to the buildings electrical system, many homeowners must go through the additional expense of hiring an electrician or handyman to perform this task, thus significantly raising the cost of the same.

In light of the above, it would be beneficial to provide a universal shade that can be removably secured to any existing jar-style light sconce so as to allow a user to update the appearance of the fixture without the drawbacks discussed above.

SUMMARY OF THE INVENTION

The present invention is directed to a shade system for a jar-style lighting fixture. One embodiment of the present invention can include a circular shaped resilient adaptor having a first end and a second end that are secured by a fastener. An elongated curved cover can be removably secured onto the adaptor via a connector and a complementary connector, and can function to surround the lighting fixture horizontally along a 180 degree axis.

In one embodiment, the adaptor includes a shape and size that is complementary to the shape and size of the jar of a jar-style lighting fixture. A rubber gasket can be provided along the inside surface of the adaptor to provide grip and cushioning against the glass jar.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
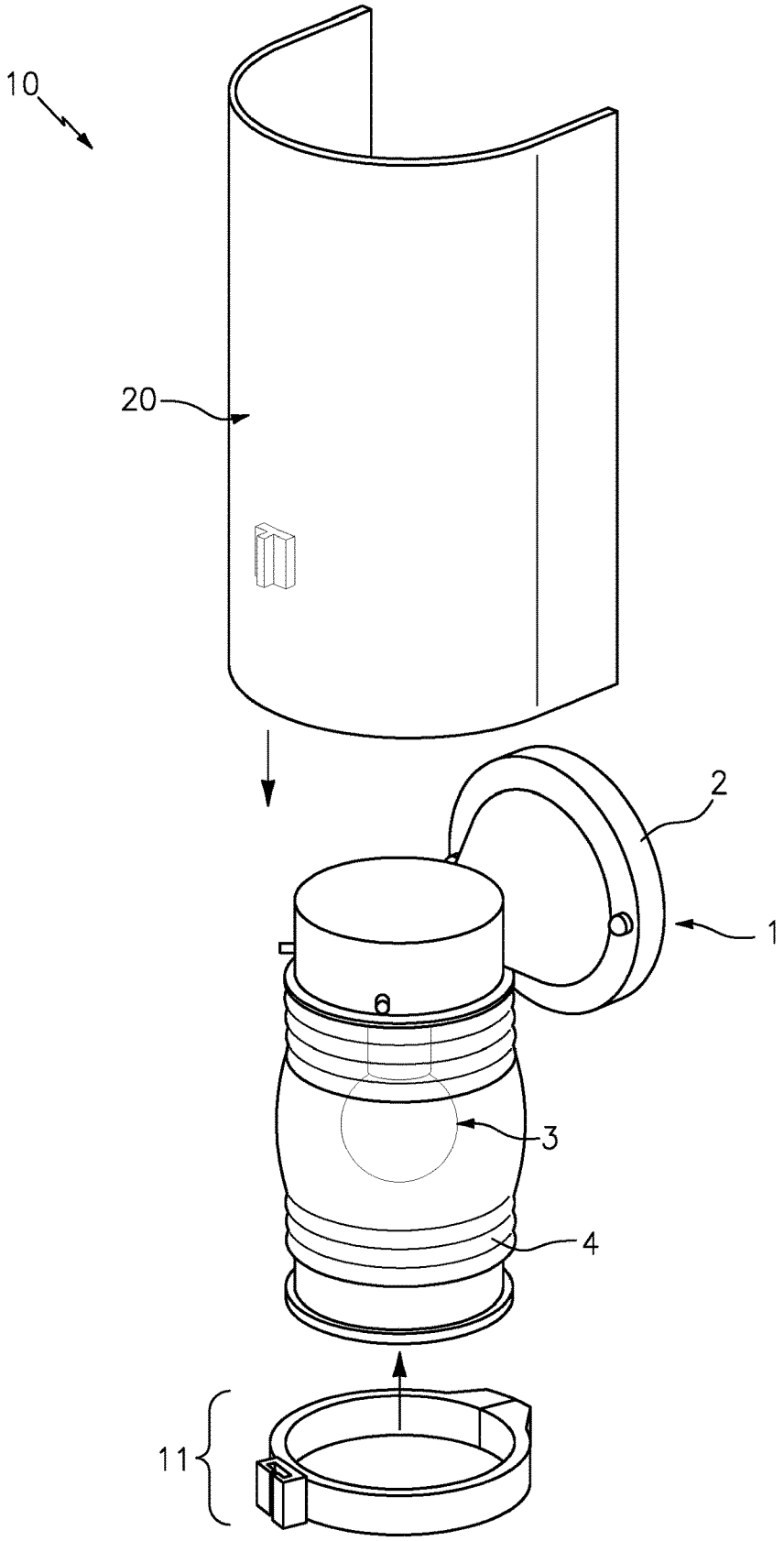
FIG. 1 is an exploded parts view of a shade system for a jar-style lighting fixture that is useful for understanding the inventive concepts disclosed herein.
Figure 2:
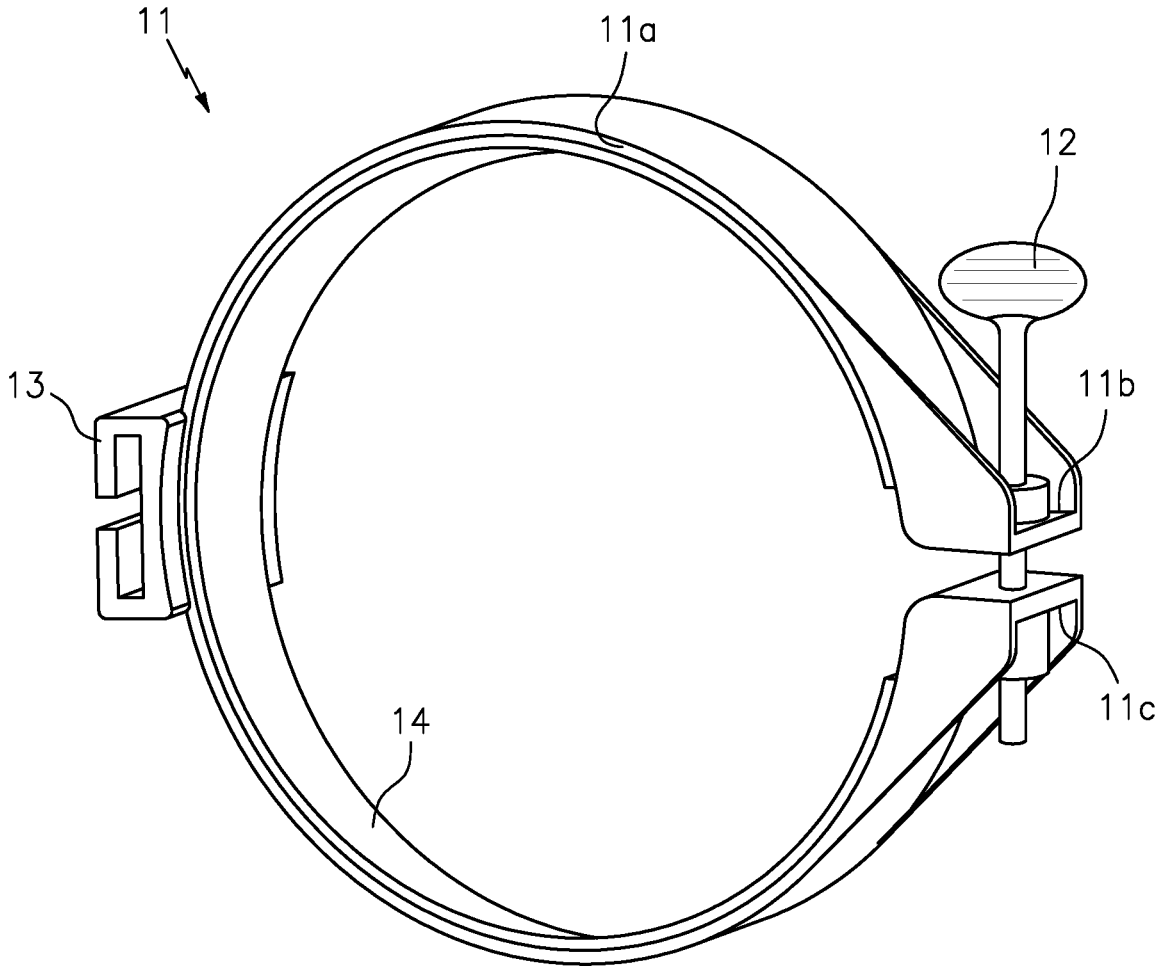
FIG. 2 is a perspective view of the adaptor of the system, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the terms "fastener" "connector" and "complementary connector" are used interchangeably to describe any type and/or number of different elements that can join two items together in a non-permanent manner. Several nonlimiting examples include opposing strips of hook and loop material (i.e. Velcro®), attractively-oriented magnetic elements, tethers and buckles such as side release buckles, compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-5 illustrate one embodiment of a universal shade system 10 for a jar-style lighting sconce that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown, the system 10 can include, essentially a light fixture adaptor 11 and a removable cover 20 for use with a jar-style light sconce fixture 1 having a body 2, a light bulb 3 and a jar 4 that surrounds the bulb.

The adaptor 11 can function to removably engage an existing lighting sconce and to position the cover 20 in the manner described below. In one embodiment, the adaptor 11 can include a single main body member having a circular central section 11*a*, a first end 11*b*, and a second end 11*c*.

In the preferred embodiment, the first and second ends 11*b* and 11*c* can extend away from the circular central section 11*a* and can include apertures through which a fastener 12 such as the illustrated thumb screw and threaded nut, for example can be positioned. The fastener functioning to selectively tighten and loosen the adaptor to the fixture based on a twisting motion. Of course, the fastener is not to be construed as limiting to the illustrated thumb-screw type device, as any number of other types of fasteners/connectors are also contemplated.

In one embodiment, the adaptor 11 can also include a connector 13 in the form of a slotted channel, for example, that can function to removably engage a complementary connector 23 in the form of a T-shaped protrusion on the below described cover 20.

In the preferred embodiment, the main body of the adaptor 11 and connector 13 can be constructed from a single piece of molded plastic and can include resilient qualities so as to maintain the illustrated shape of the central section and the orientation of the first and second ends. Of course, the main body of the adaptor 11 and/or connector 13 can be formed from any number of other materials that are, for example, relatively strong and stiff for their weight. Several nonlimiting examples include, but are not limited to various metals or metal alloys (e.g., aluminum, steel, titanium, or alloys thereof), different types of plastic/polymers (e.g., high-density polyethylene (HDPE), rigid polyvinyl chloride (PVC), or polyethylene terephthalate (PET)), and/or various composite materials (e.g., carbon fibers in a polymer matrix, fiberglass, etc.), for example.

In one embodiment, a gasket 14 can be positioned along the inside facing surface of the main body. The gasket can preferably be constructed from a soft, high friction material such as rubber or neoprene, for example, that can grip a glass surface without slipping off. As described herein, a "soft" surface includes any material that is not rigid and is capable of bending/flexing in any direction. Likewise, the term "high friction" means any material that can adhere to a glass surface with sufficient strength to prevent slippage of the main body relative to the fixture.

The cover 20 can be removably secured onto the adaptor 11 and can function to fully enclose, partially enclose, or otherwise disguise the existence of the jar-type light fixture to which the main body is secured.

In this regard, the cover 20 can include a main body 21 having any number of different shapes, sizes and construction materials. In the preferred embodiment, the main body 21 can be constructed from a single piece of curved lightweight and generally translucent plastic, so as to allow light generated by the fixture's light bulb to be dispensed through the cover. Of course, other embodiments are also contemplated wherein the cover is constructed from a translucent, semi-translucent or opaque material. Moreover, the cover may be constructed from any number of other materials such as various types of metals and/or glass, for example.

Figure 3:
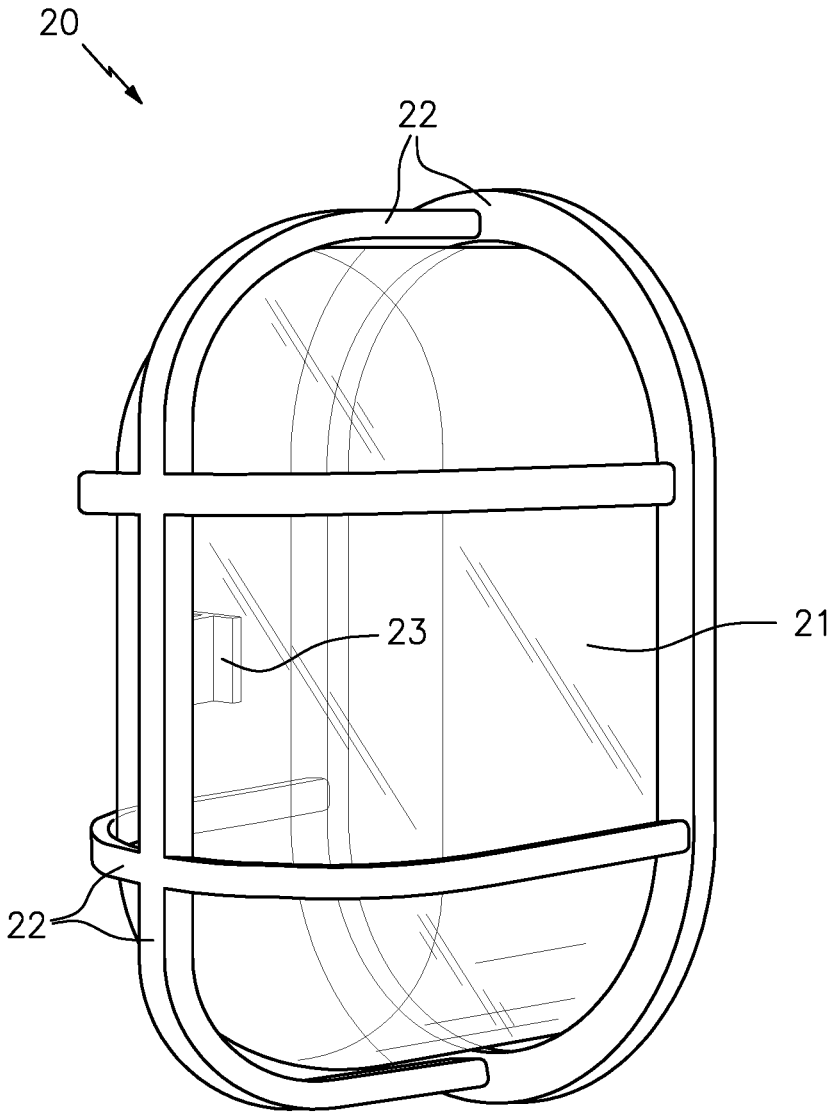
FIG. 3 is a perspective view of the cover of the system, in accordance with one embodiment of the invention.

In various embodiments, the cover can include one or more decorative elements 22 such as the nautical lines shown at FIG. 3, for example. As described herein, a "decorative element" can include any number and type of different colors, markings, words, shapes, symbols, logos, designs, types of materials, texturing of materials, patterns or images, for example. These elements can be secured onto and/or into the main body of the cover in accordance with known techniques so as to be flush with the surface thereof, recessed and/or raised so as to give a three-dimensional effect.

In one embodiment, a complementary connector 23 such as the illustrated T-shaped protrusion, for example, can be disposed along the inside facing surface of the cover 21. The connector 23 functioning to engage the slotted channel 13 of the adaptor so as to allow the cover to be removably secured thereto. Although described and illustrated with regard to a particular type of connector, this is for illustrative purposes only. To this end, any number of other types of connectors as defined above are also contemplated for use herein.

Figure 4:
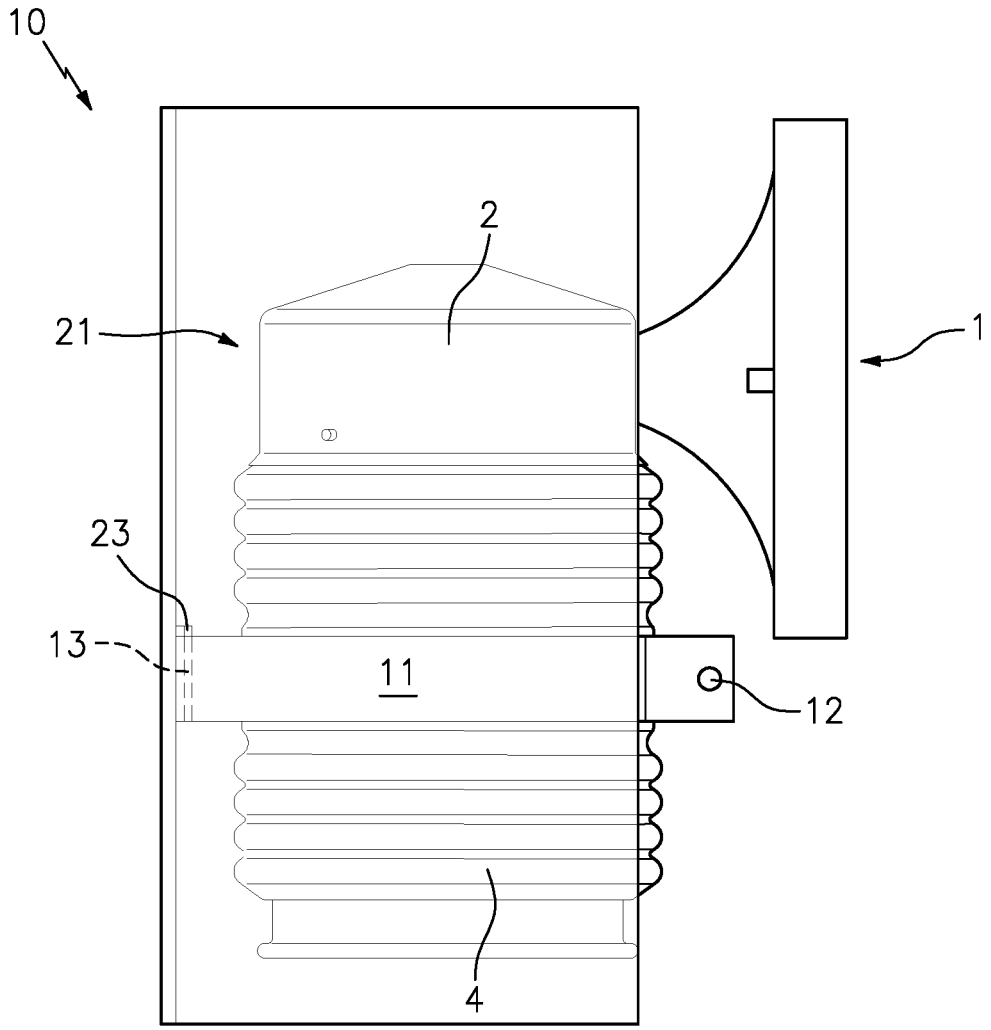
FIG. 4 is a perspective view of the system in operation, in accordance with one embodiment of the invention.

In operation, and as shown at FIG. 4, the adaptor 11 can be positioned along the outside of the glass jar 4 of a light fixture 1. Once positioned, the fastener 12 can be tightened to secure the adaptor in place. Next, the connectors 13 and 23 can be aligned and engaged, so as to position the cover 20 along the outside of the fixture.

Figure 5:
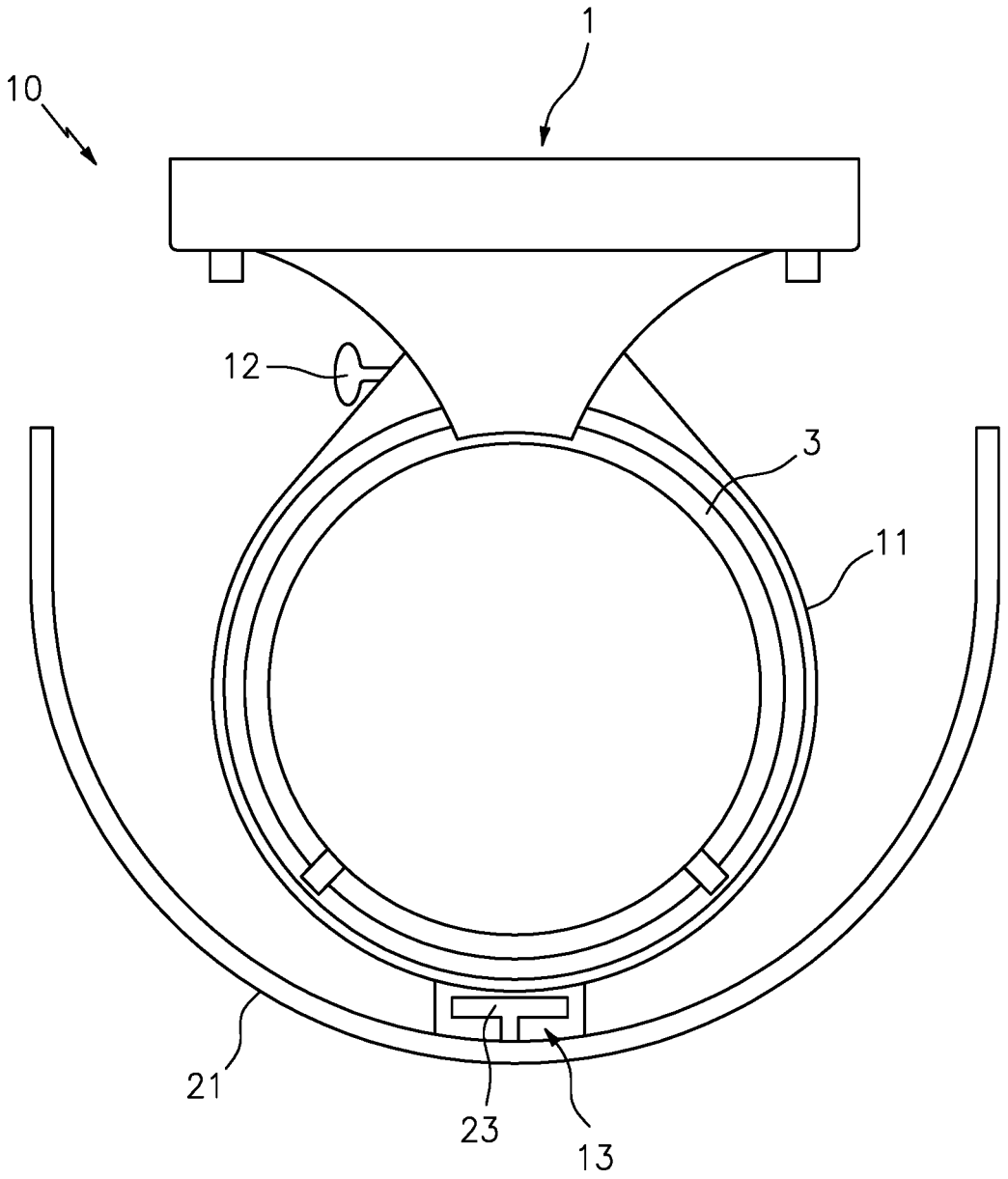
FIG. 5 is a top view of the system in operation, in accordance with one embodiment of the invention.

As shown best at FIG. 5, when so positioned the cover 20 surrounds the lighting fixture 1 along a complete 180-degree horizontal plane, so as to hide the fixture from view. Moreover, because light generated by the fixture's bulb 3 can pass through the cover 20, the system does not affect the normal operation of the lighting fixture.

Accordingly, the above described universal shade system for jar-style lighting fixtures allows users to update existing fixtures with a completely new and modern look that is chosen by the user, without affecting the operation of the original fixture and without requiring replacement of the same.

Although described above with regard to a particular shape or size, this is for illustrative purposes only, as the adaptor 11 and cover 20 can each include an unlimited number of different shapes and sizes. Moreover, one or more elements of the system 10 can be secured together utilizing any number of known attachment means such as, for example, screws, glue, compression fittings and welds, among others. Further, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A shade system for a jar-style lighting fixture, said system comprising:

an adaptor having a first end, a second end, a circular central section and an outside facing surface;

a cover having an inside facing surface and an outside facing surface;

a connector that is disposed along the outside surface of the adaptor; and a complementary connector that is disposed along the inside surface of the cover, wherein the connector and complementary connector include functionality for removably securing the cover onto the adaptor, and wherein the connector includes a slotted channel, and the complementary connector includes a T-shaped protrusion.

2. The device of claim 1, wherein the circular central section of the adaptor includes a diameter that is complementary to a diameter of a jar on a lighting fixture.

3. The device of claim 2, further comprising:

a fastener that is positioned between the first end and the second end of the adaptor, said adaptor functioning to selectively tighten and loosen the adaptor to the lighting fixture.

4. The device of claim 3, wherein the fastener comprises a thumb screw and threaded nut.

5. The device of claim 1, wherein the T-shaped protrusion includes a shape and size that is complementary to a shape and size of the slotted channel, and the T-shaped protrusion is configured to be removably secured within the slotted channel.

6. The device of claim 1, wherein the cover includes a generally curved shape.

7. The device of claim 1, wherein the cover is constructed from a transparent material.

8. The device of claim 1, wherein the cover is constructed from a translucent material.

* * * * *